US006749473B1

(12) United States Patent
Lower

(10) Patent No.: US 6,749,473 B1
(45) Date of Patent: Jun. 15, 2004

(54) EXTENSIBLE SAFETY SIGNAL DEVICE

(76) Inventor: Kitty Lower, 812 W. Lincoln Ave., Ionia, MI (US) 48846

( * ) Notice: Subject to any disclaimer, the term of this patent is extended or adjusted under 35 U.S.C. 154(b) by 0 days.

(21) Appl. No.: 10/283,633

(22) Filed: Oct. 30, 2002

(51) Int. Cl.[7] ..... B63C 9/08
(52) U.S. Cl. ..... 441/89; 116/173
(58) Field of Search ..... 441/89; 116/173

(56) References Cited

U.S. PATENT DOCUMENTS

| | | | | |
|---|---|---|---|---|
| 51,971 | A | | 1/1866 | Rousseil |
| 309,032 | A | | 12/1884 | De Ledochowski |
| 827,350 | A | | 7/1906 | Crofford |
| 988,830 | A | | 4/1911 | Smith |
| 4,035,856 | A | | 7/1977 | Oberg |
| 4,498,879 | A | | 2/1985 | Burr |
| 4,598,661 | A | | 7/1986 | Roe |
| 4,752,264 | A | | 6/1988 | Melendez et al. |
| 5,083,956 | A | | 1/1992 | Chraghchian et al. |
| 5,114,369 | A | | 5/1992 | Coffey |
| 5,651,711 | A | * | 7/1997 | Samano ..... 441/89 |
| 6,289,840 | B1 | * | 9/2001 | Hill ..... 116/209 |

* cited by examiner

*Primary Examiner*—Jesus D. Sotelo
(74) *Attorney, Agent, or Firm*—Young & Basile, P.C.

(57) ABSTRACT

A signaling device for enhancing the visibility of the wearer of the device. A flexible coilable resilient rod is provided with a flag. The rod is designed to be coilable or collapsible into a compact configuration and stored within and confined by a container. The container is provided with a quick opening closure which permits release of pressure on the rod, allowing the rod to spring into an erect position.

1 Claim, 2 Drawing Sheets

EXTENSIBLE SAFETY SIGNAL DEVICE

FIELD OF THE INVENTION

This invention pertains to a signaling device to be worn by a person, and more particularly, to an extensible device which automatically extends to signal the location of a person upon activation of a release mechanism.

BACKGROUND OF THE INVENTION

A number of devices have been developed for signaling the location of a person in the water. It is well known that on an open body of water, particularly one interrupted by waves or other surface irregularities, it can be extremely difficult to locate a person floating in the water, even at relatively close range.

For that reason, a number of inventions have been developed over the years to signal the position of a person in the water. Typical of these devices are those disclosed by Rousseil, U.S. Pat. No. 51,971, Ledochowski, in U.S. Pat. No. 309,032, and Smith, in U.S. Pat. No. 988,830, all of which depict flotation devices to which segmented flag staffs with signaling flags may be assembled and attached.

It is also well known to affix such flag staffs and signaling flags to the flotation vests of those engaged in water sports, as is taught by Oberg, in U.S. Pat. No. 4,035,856, Roe, in U.S. Pat. No. 4,598,661 and Melendez et al., in U.S. Pat. No. 4,752,264. These inventors have developed either fixed or extensible signaling means particularly useful for water skiers.

Efforts have also been made to produce signaling devices which are automatic, extending a flag or warning marker above the head of a person in the water, for example, as taught by Chraghchian et al., in U.S. Pat. No. 5,083,956. This type of device, however, is limited in that the elevation of an extensible signal which relies strictly on flotation, as does Chraghchian, which is limited by the length or travel of the floatable, buoyant element which extends the signal. While efforts at deployment of signaling devices further above the body of the person wearing the device have been attempted, for example, by Crofford, as shown in U.S. Pat. No. 827,350, such devices require a complicated release mechanism which is not easily reusable.

It is apparent, therefore, that there is a need for an improved personal signaling device which deploys at a much greater height from the body of the person, in a method requiring only the simplest of mechanical elements, and which is readily restowable and reusable.

SUMMARY OF THE INVENTION

The present invention, therefore, is an extensible signaling device designed to be integrated with or attached to an article worn by a person, such as a flotation vest.

The device comprises a flag attached to a flexible elongate rod which has sufficient stiffness to maintain an erect configuration when deployed, yet sufficient resilience to allow it to be collapsed in a coil and contained within an enclosure when not in use.

The natural resilience of the rod material is such that release of the rod from its confinement in a container results in the self-deployment, by uncoiling of the rod to its extended position.

The invention is designed to be integrated with a life vest, such as that which might be worn by a water skier, or to be contained within a separable enclosure which may be affixed to such a flotation device, or to any other article of apparel which may be worn by a person. In a still further embodiment, the device may be easily incorporated into an outdoorsman's knapsack or outerwear, allowing the deployment of the warning device by persons other than water skiers, for example, snow skiers in avalanche areas, or hunters or hikers in tall grass environments.

DETAILED DESCRIPTION OF THE DRAWINGS

FIG. 1 s a stylized perspective view of a person utilizing the device, showing the warning flag and mounting rod in full extension.

DETAILED DESCRIPTION OF THE EMBODIMENT

Figure 1:
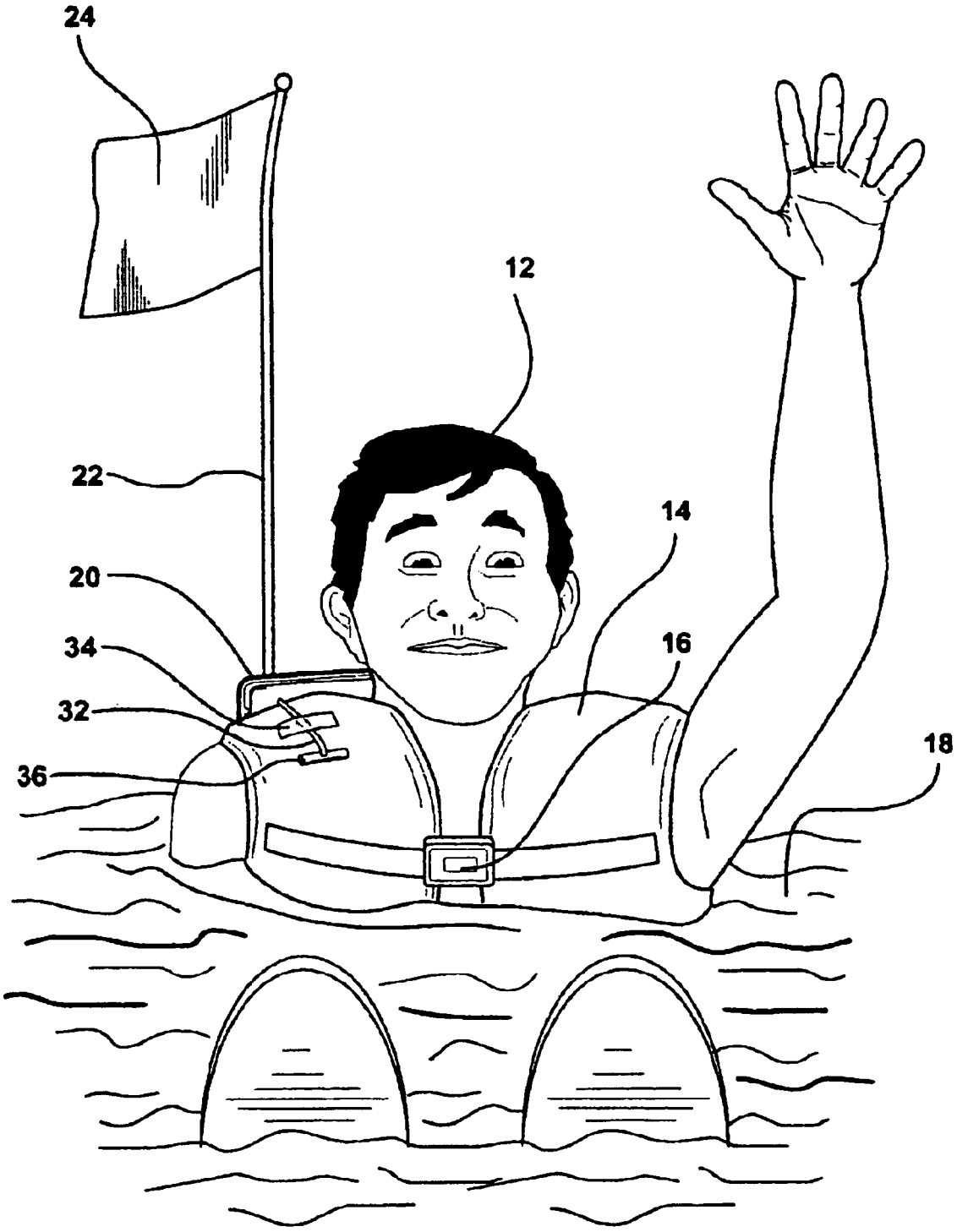
Figure 2:
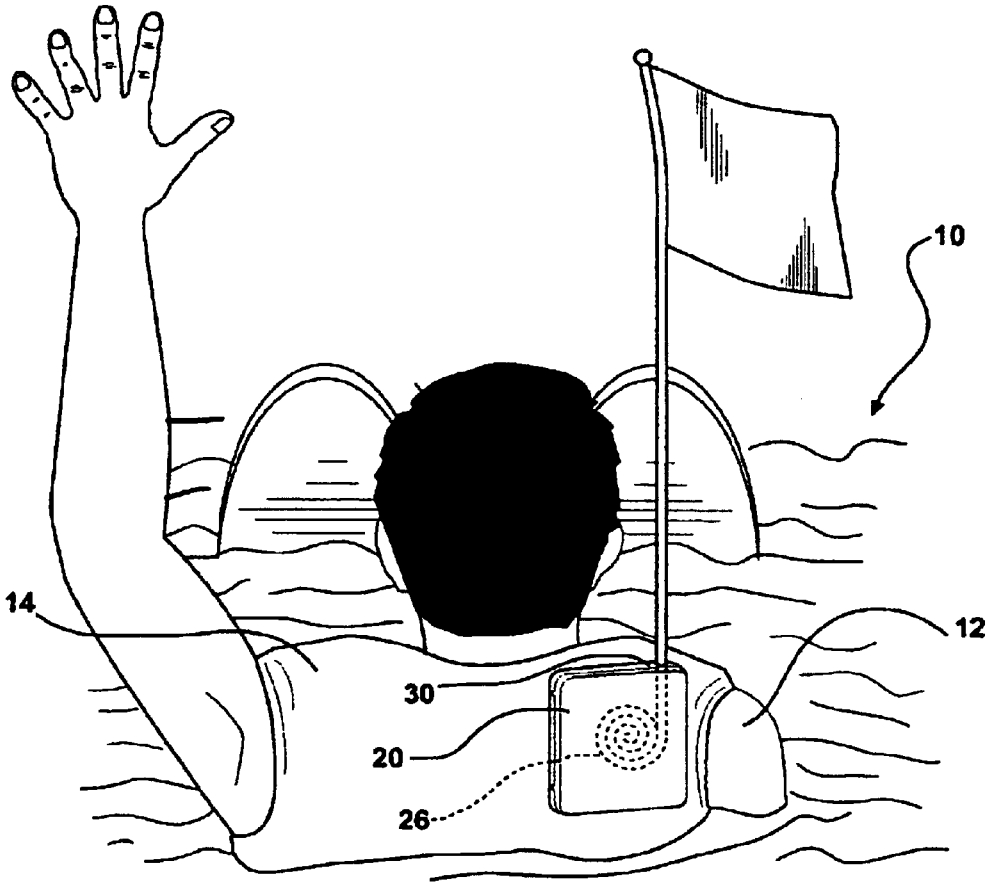
FIG. 2 is a stylized view of an individual wearing the invention, showing the invention mounted to the back of a flotation device.
Figure 3:
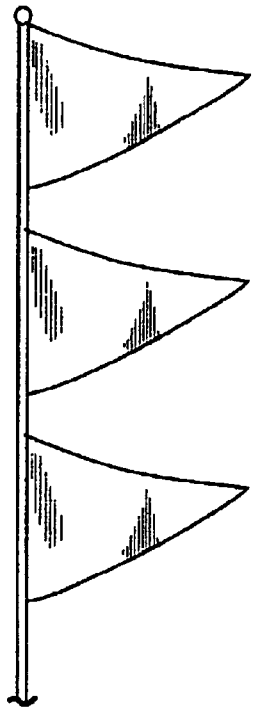
FIG. 3 is a side view of an alternate embodiment of one part of the invention, showing multiple signal flags mounted to a single rod.

The invention and its operation will be easily understood by reference to FIGS. 1 through 3. In one embodiment of the invention, an individual, such as a water skier 12 is provided with a self-contained signal assembly invention 10. The invention comprises a compartment 20 which may be permanently or removably attached to a flotation device 14, such as a life jacket or life preserver, typically of the vest-type as worn by those participating in water sports. Such flotation device 14 is preferably equipped with fasteners 16 which allow easy donning and removal of the device 14. The flotation device 14 is provided with a guide 34 through which may be passed a rip cord 32, which in turn, is provided with a handle 36. The rip cord 32 engages a closure 30 which holds the compartment 20 in a closed position. Closure 30 may be any of a number of well known rapid opening and closing type closures, such as a conventional zipper, or a hook and loop type fastener. Preferably, the closure 30 traverses fifty percent or more of the perimeter of the compartment 20. The compartment 20 may be either rigid or flexible. In an embodiment incorporating a rigid compartment 20, the compartment 20 comprises a hinged enclosure which is held in a closed position by closure 30. Flexible rod 22, when stored, approximates the configuration of a helical spring, and urges the two halves of the compartment 20 apart. As long as closure 30 holds compartment 20 in a closed position, the flexible rod 22 is contained. Disengagement of closure 30 allows compartment 20 to open about its hinge, thereby releasing flexible rod 22. Flexible rod 22 is mounted within compartment 20 in such fashion as to insure that flexible rod 22 extends upwardly from the compartment 20, above the head of the skier 12. Compartment 20 may also be a soft-sided compartment constructed of durable fabric. In this embodiment, closure 30 serves to close an opening formed in the perimeter of compartment 20. Said opening is of sufficient dimension to permit rapid deployment of flexible rod 22 as herein described upon release of the closure 30 which holds the compartment 20 in the closed position.

Within compartment 20 is stored a flexible rod 22 in a coiled configuration 26. The proximal end of the flexible rod 22 is secured to the inside of the compartment 20, while the distal end is provided with a flag 24, preferably of a weatherproof material with a high visibility pattern or color. Flexible rod 22 is comprised of a tough yet resilient weatherproof material which may be fiberglass reinforced plastic, carbon fiber reinforced plastic, or any of a wide variety of spring steel alloys. The inner dimensions of compartment 20 are selected to accommodate the coiled rod 26, which is the condition of the rod in the "stored" state. Release of closure 30 permits the rear of the compartment 20 to partly separate from the front of compartment 20 allowing flexible rod 22 to deploy once the retaining forces of the walls of compartment 20 have been relaxed by release of the closure 30. This results in the flexible rod 22 extending to its full length in a whip-like fashion, thereby elevating the rod 22 and its associated flag 24 above the height of the top of the compartment 20 and above the head of the skier 12.

In operation, assuming that the user of the invention has fallen or is otherwise in need of retrieval, the user grasps the handle 36 and pulls, thereby opening the closure 30 of compartment 20 allowing coil rod 26 to extend to full length.

Once the individual has been retrieved, or it has been otherwise determined that it is no longer necessary for the signal device to be deployed, the flexible rod 22 can be coiled, by hand, into the coiled configuration 26 and again stowed inside compartment 20 by virtue of closure 30. This design allows for reuse. As can be appreciated from an examination of FIG. 2, it is possible to design the assembly 10 to be permanently affixed to a flotation device 14 or, in the alternative, to be removably affixed to such device.

In an embodiment of the invention as shown in FIG. 3, rod 22 is provided with a plurality of flags 24 spaced apart along the length of rod 22, and offering even greater visibility than that provided by a single flag 24.

In yet another embodiment of my invention, closure 30 may be designed to operate automatically upon contact with the closure 30 with water 18. In this embodiment, a single catch serves to prevent the opening of compartment 20. This catch is in the form of a spring-loaded element which is maintained in the closed or locked position by a water soluble pellet. In this embodiment, even if the user of the invention is unconscious or otherwise incapacitated, contact between the water soluble pellet and water results in the immediate dissolution of the pellet and release of the catch, thereby releasing the closure and permitting the coiled rod 26 to be extended into straight rod 22 as above described.

It will be readily apparent to those skilled in the art that the invention may likewise have utility in use by hunters, skiers and outdoorsmen who wish to be able to provide a rapidly deployable visible signal of their presence, for example, in high grass or deep snow. The invention may be fitted to a garment in the same fashion as it is fitted to a flotation vest as above described. In all other aspects, use and deployment of the invention is identical to its use and deployment in a marine setting as above described.

While the invention has been described in connection with what is presently considered to be the most practical and preferred embodiments, the invention is not limited to those disclosed embodiments. To the contrary, the Applicant intends that this disclosure cover various modifications and equivalent arrangements included within the spirit and scope of the appended claims, which scope is intended to be accorded the broadest interpretation so as to encompass all such modifications and equivalent structures as is permitted under the law.

I claim:

1. A signaling device worn by an individual comprising:

a compartment;

a flexible rod adapted to be collapsed into a compact configuration and stored within said compartment;

closure means for maintaining said compartment in a closed state, whereby said flexible rod is contained therein;

a water-soluble pellet for releasing said closure means; and signal means to affixed said rod.

* * * * *